United States Patent [19]

Karabedian et al.

[11] Patent Number: 4,915,217

[45] Date of Patent: Apr. 10, 1990

[54] CONTAINER PACKAGE

[75] Inventors: James A. Karabedian, Toledo; David A. Pratt, Waterville, both of Ohio

[73] Assignee: Owens-Illinois Plastic Products Inc., Toledo, Ohio

[21] Appl. No.: 385,635

[22] Filed: Jul. 26, 1989

Related U.S. Application Data

[63] Continuation-in-part of Ser. No. 319,775, Mar. 7, 1989.

[51] Int. Cl.[4] ..... B65D 75/00

[52] U.S. Cl. ..... 206/150; 206/161

[58] Field of Search ..... 206/145, 150, 151, 161

[56] References Cited

U.S. PATENT DOCUMENTS

| | | | |
|---|---|---|---|
| 3,084,792 | 4/1963 | Poupitch | 206/150 |
| 3,346,106 | 10/1967 | Gooding | 206/151 |
| 4,116,331 | 9/1978 | Curry et al. | 206/150 |
| 4,471,870 | 9/1984 | Uhlig | 206/150 |
| 4,709,808 | 12/1987 | Balduff et al. | 206/158 |
| 4,740,415 | 4/1988 | Hirschberger | 206/150 |

FOREIGN PATENT DOCUMENTS

| | | | |
|---|---|---|---|
| 2092546 | 8/1982 | United Kingdom | 206/150 |

*Primary Examiner*—William Price

[57] ABSTRACT

A container package comprising an array of cans, each of which has a body portion, an annular bead on the upper end thereof having a smaller diameter than the body portion and an inclined portion extending from the body portion to the bead, and a carrier. The carrier comprises a sheet of flexible plastic material having a plurality of openings forming an array for receiving the ends of the cans. The cans are inserted upwardly into the openings and retained by the carrier by flexing of the periphery of each opening upwardly against the bead of each can. The modulus of elasticity, the thickness of the sheet and the spacing and size of the openings are such that the cans are maintained in abutting relationship. The upper ends of the cans are substantially in a single plane when the package is lifted through finger openings in the sheet.

22 Claims, 6 Drawing Sheets

CONTAINER PACKAGE

This application is a continuation-in-part of patent application Ser. No. 319,775 filed Mar. 7, 1989.

This invention relates to container packages and particularly to can packages.

BACKGROUND AND SUMMARY OF THE INVENTION

In the handling and the packaging of cans, it is common to use a carrier having an array of openings therein for receiving the upper ends of the cans and holding an array of cans to form a container package. Typical U.S. patents showing such a carrier are U.S. Pat. Nos. 3,874,502, 4,219,117, and 4,586,742.

Such a carrier comprises a series of bands or rings which are non-circular and is applied by lateral stretching by a machine which inserts fingers into the openings to stretch the openings to a generally circular configuration and then the carrier is forced onto the upper end of the cans through the neck below the chime or bead on the cans. During the stretching and application, the bands are folded downwardly along the peripheral surface of the necks of the cans. The resultant package comprises a plurality or array of the cans surrounded by the stretched plastic rings. In such a package, once the cans are removed from the carrier, it is difficult if not impossible to reinsert the cans. Accordingly, the cans can not be readily handled for returning the cans for salvage or reclaiming.

A further problem with carriers of the common ring type which have an array of openings is that when an attempt is made to use the carriers for a large number of cans, for example 8 or 12 cans, and the package is lifted, the cans move axially relative to one another making the package sag substantially. When the user lifts the package, such a package gives a sense of instability and a loss of can security. Furthermore, it is not convenient to grasp such a package through finger openings in the carrier. Where such packages have heretofore been proposed, a band has been provided about the carrier. Accordingly, it has been suggested that in ring carriers of the type shown, for example, in U.S. Pat. Nos. 3,874,501, 4,586,742 and 4,219,177, it is necessary to provide a band with an integral handle about the bodies of the cans where a larger number of cans are provided, such as twelve cans. See U.S. Pat. Nos. 4,269,308, 4,385,690, 4,385,691, 4,471,010, 4,520,924 and 4,828,110. In such packages, when the handle on the band is grasped and the package is lifted, it has been found that the lower ends of the cans may possibly engage the pull tabs of the underlying package in a stack causing inadvertent opening of the cans.

Earlier U.S. Pat. Nos. 2,874,835 and 2,997,169 have shown packages for cans of uniform diameter comprising a plastic sheet which also engages the upper ends of the cans along a cylindrical surface portion in a manner similar to the above-described ring carriers.

Alternatively, it is common to provide a larger number of cans in cardboard boxes or to provide a shrink film about a large group of cans as shown, for example, in U.S. Pat. No. 4,289,236.

In our aforementioned application Ser. No. 319,775, the container package comprises an array of cans and a carrier. The carrier includes a sheet of stiff but flexible plastic material having a plurality of openings forming an array for receiving the ends of the cans and one or more films of plastic material coextensive with the sheet and bonded to the periphery of the sheet so that it is flat and taut on the sheet. The cans are inserted upwardly into the openings and retained by the carrier by flexing of the periphery of each opening upwardly against the chime or bead of each can. As the cans are inserted, the film is stretched taut over the upper ends of the cans. The film is stretched substantially flat and taut from one peripheral edge to an opposite peripheral edge. The carrier thus protects the cans from contaminants. The carrier supports the array of the cans so that the upper ends of the cans are in a single plane when the package is lifted through finger openings in the film and sheet. The film and sheet define a substantially flat planar upper surface. Indicia such as printing, advertising, logos, artwork and other markings are provided on the film preferably on the entire surface of the film.

Among the objectives of the present invention are to provide a container package which utilizes a carrier which will effectively maintain the upper ends of the cans in a single plane when the package is lifted, even when a larger number of cans are lifted such as twelve cans; which will withstand the conditions of handling, storage, shipping and stacking; which will be aesthetically pleasing; wherein the carrier can be used for returning the containers for salvage or recycling; and which can be applied to the cans at commercially acceptable speeds.

Among the further objectives of the present invention are to provide a container package which holds the containers such as cans in tight side-by-side relationship when the package is lifted so that it is readily handled and transported; wherein each container can be readily released by a downward movement relative to the carrier; wherein each container can be readily reinserted; wherein no additional band is required about the cans; and which can be manufactured at low cost.

In accordance with the invention, the container package for cans embodying the invention comprises a sheet of flexible plastic material having a plurality of openings for receiving the upper ends of the cans, the cans extending upwardly through the openings in the sheet with the periphery of the openings flexing upwardly and inwardly beneath the bead of the cans. The modulus of elasticity of the sheet, the thickness of the sheet, and the spacing and size of the openings are such that the bodies of the cans are maintained in abutting relationship, and the upper ends of the cans are maintained in substantially the same plane when the package is lifted through finger holes in the sheet.

DESCRIPTION

Figure 1:
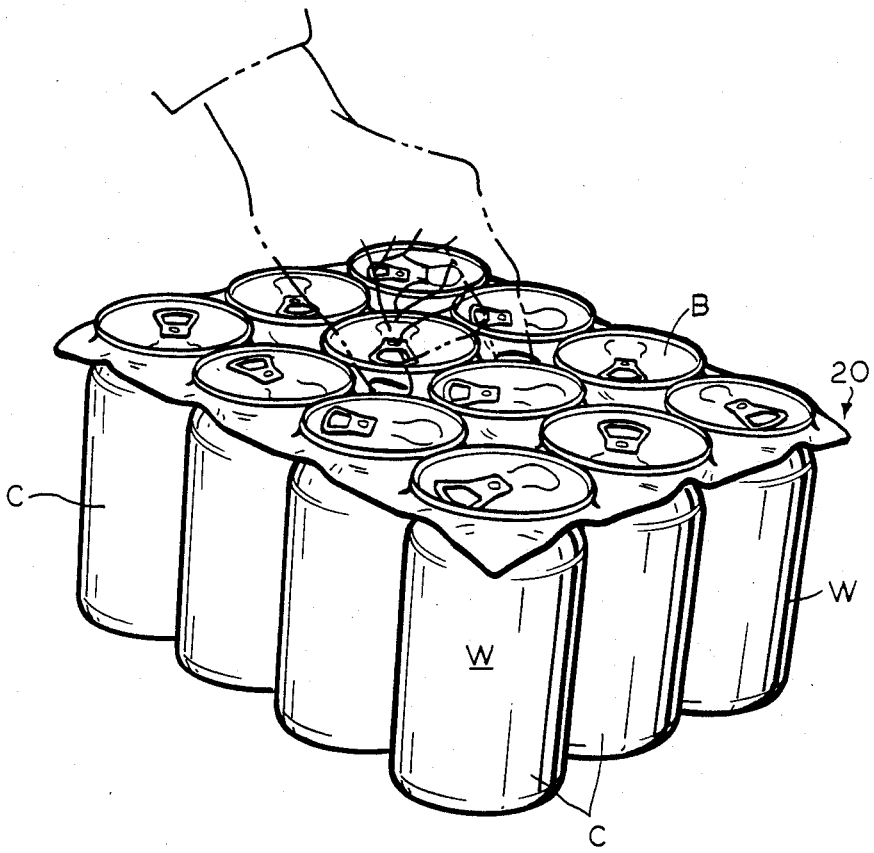
FIG. 1 is a perspective view of a container package embodying the invention.
Figure 5:
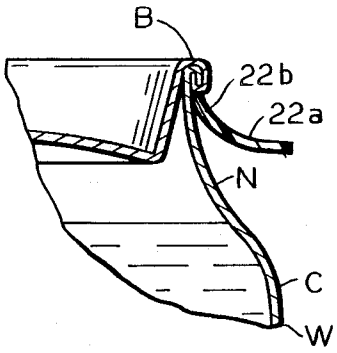
FIG. 5 is a fragmentary sectional view on an enlarged scale of a portion of FIG. 4
Figure 3:
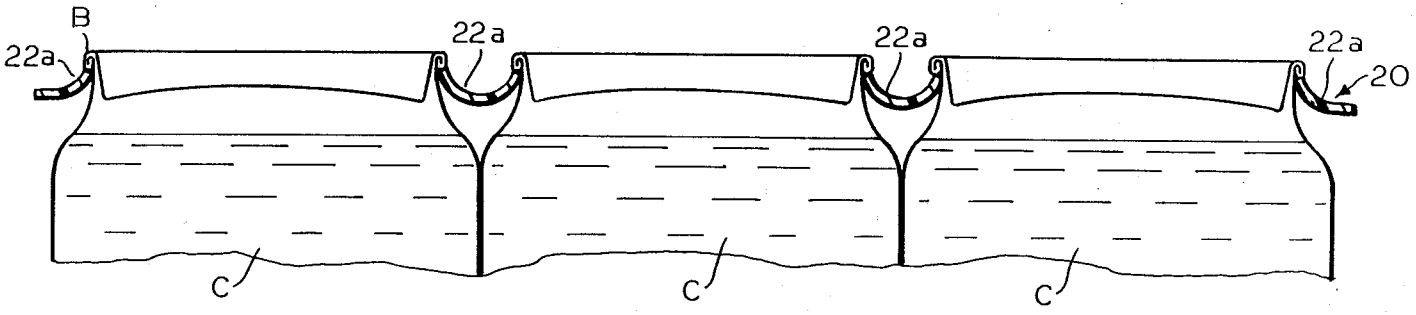
FIG. 3 is a longitudinal sectional view of the package.
Figure 4:
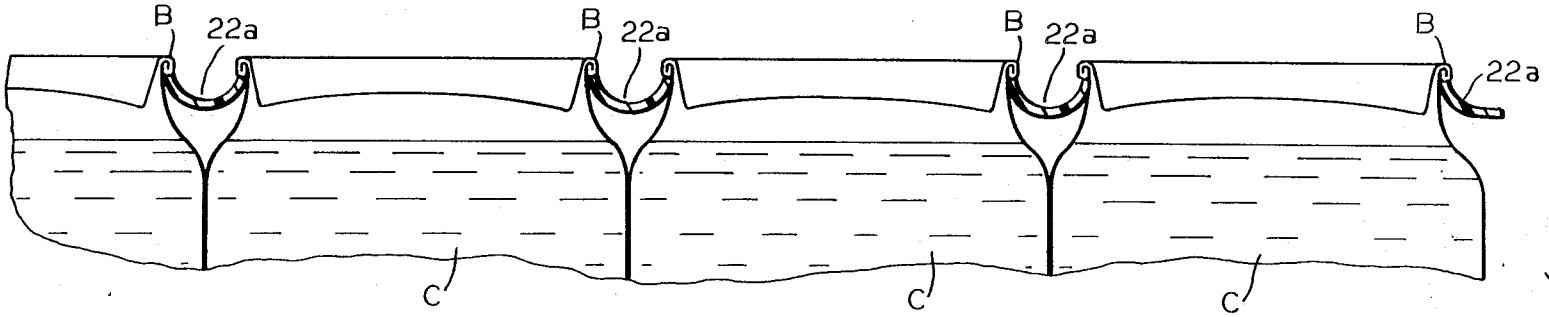
FIG. 4 is a fragmentary transverse sectional view of the package.
Figure 6:
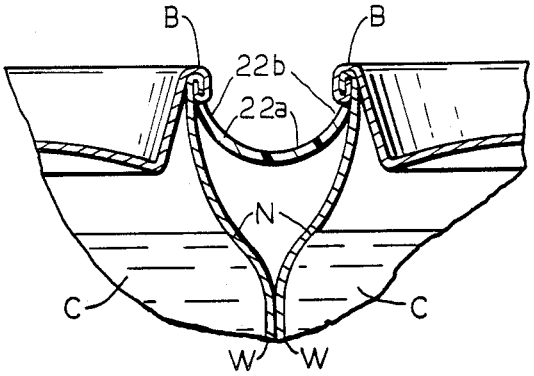
FIG. 6 is a fragmentary sectional view on an enlarged scale of another portion of FIG. 4.

Referring to FIG. 1 the container package embodying the invention comprises a carrier 20 including a plurality or array of containers C, such as 12 cans, supported so the side walls W of the containers C are in adjacent abutting relation. As is common in cans, the cans include a body portion and an annular chime or bead B that is connected to the side wall W by a tapered neck portion N (FIGS. 5, 6).

Referring to FIGS. 2–6, the carrier 20 comprises a sheet 21 of relatively stiff flexible plastic of uniform thickness which is generally rectangular and has a plurality of openings 22 corresponding in number to the number of cans for the package, preferably twelve. The openings 22 have a cross sectional area slightly less then the diameter of the cans below the bead B. As shown, the openings 22 are circular.

Figure 2:
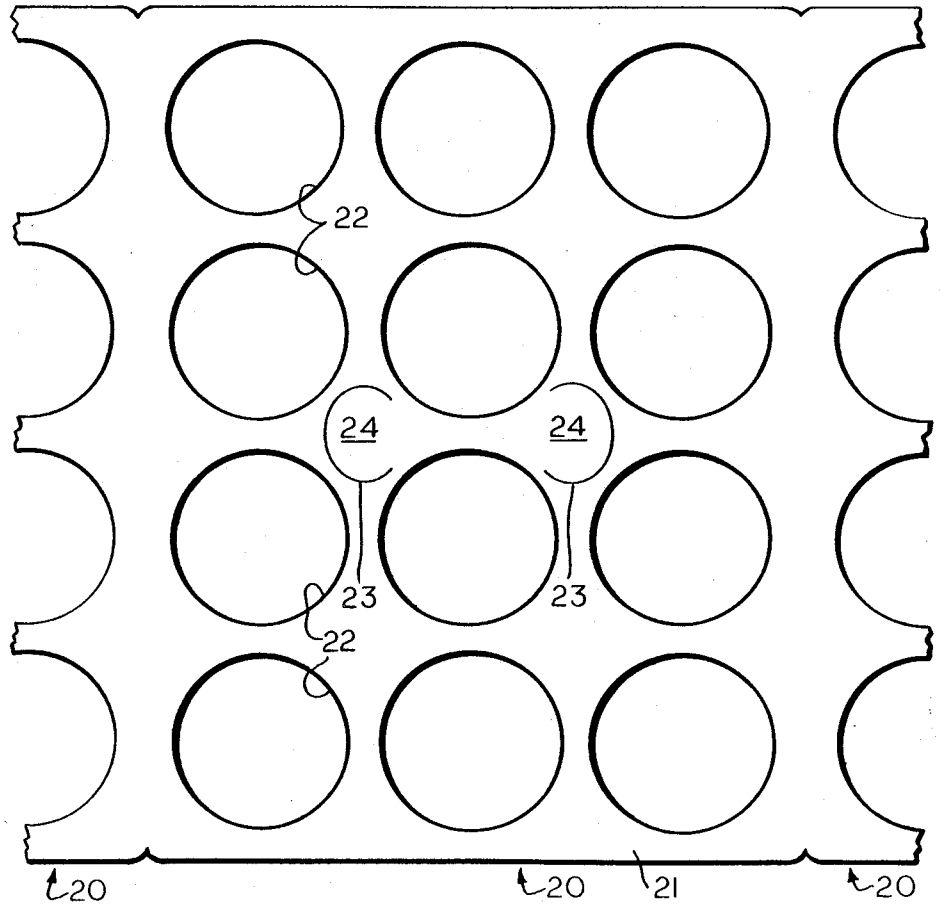
FIG. 2 is a plan view of the portion of a web of carriers utilized in the package.

The carrier 20 further includes portions partially cut to form arcuate slots 23 in the sheet 21 to define tabs 24 (FIG. 2), each of which comprises a layer of plastic from the carrier sheet 21 (FIG. 2). Tabs 24 are adapted to be bent downwardly to provide openings to receive the fingers of a hand in order to lift and carry the package, the openings being preferably spaced longitudinally of the strip of carriers (FIG. 2).

In an array of twelve cans, wherein the sheet has three rows of openings transversely of the web of carriers (FIG. 2), each row having four openings, the finger slots 23 are preferably positioned at central areas of the sheet which are on opposite sides of the center row of four openings. In this manner, the fingers extend under the sheet along the central row of four cans when the package is lifted. In addition, the openings are preferably oval and the hinge portion of each tab 24 is parallel to the rows of four openings so that the greater dimension (major axis of the opening) extends parallel to the rows of four openings. When the thumb and second finger are inserted, the tabs are folded along the hinge in underlying relation to the sheet between the central openings along the central row of four cans to distribute the load of the cans at the central portion of the sheet.

Except for the openings 22 and slots 23, the sheet is preferably imperforate.

As shown in FIGS. 3–6, when the carrier 20 is applied to the cans either preferably by progressively forcing the carrier downwardly onto an array of cans from one end of the array to the other or by simultaneously forcing the carrier downwardly onto the array, the portions 22*a* of the periphery of the openings 22 are flexed outwardly about the beads B of the cans C and then flexed radially inwardly below the beads B. It may be noted that the periphery of the portion of the carriers surrounding the opening flexes only sufficiently to extend upwardly beneath the bead (FIG. 6) but preferably not such that it is stretched and engages and conforms to the neck N of the can C as occurs in conventional ring type can carriers. Such ring type carriers that are commercially used at the present time are shown in the aforementioned U.S. Pat. Nos. 3,874,502, 4,219,177, and 4,586,742.

The center to center distance between adjacent openings 22 before the carrier is applied is not greater than and preferably slightly less than the center to center distance between abutting cans. The proper flexing of the periphery of each opening about the can and beneath the bead of each can is achieved by placement of the center of each opening so that the body of the cans abut one another.

The sheet of flexible stiff plastic has a uniform thickness and a sufficiently high modulus of elasticity so that the periphery of the openings will flex about the upper ends of the cans only sufficiently to hold the cans and maintain the cans in contact along the body portions of the carrier and will maintain the upper ends of the cans in substantially the same plane when the package is lifted.

By utilizing a sheet 21 that has sufficient stiffness, there is provided a series of V-shaped beams between the cans about the periphery of the openings, the free edges 22*b* of which engage the beads B of the cans (FIGS. 5, 6). The free edges 22*b* extend upwardly and inwardly toward the centerline of the can at an acute angle to the centerline. These beams further stiffen the package so that when it is lifted, the upper ends of the cans lie in substantially the same plane without substantial relative movement or sagging between the cans and without the cans at the periphery flaring outwardly out of contact with remaining cans. This is shown for example by reference to FIGS. 9 and 10.

The modulus of elasticity and thickness are interrelated not only to maintain and hold the cans in the package but also to facilitate the application of the carrier to the cans as well as minimize the cost of the carrier.

Figure 7:
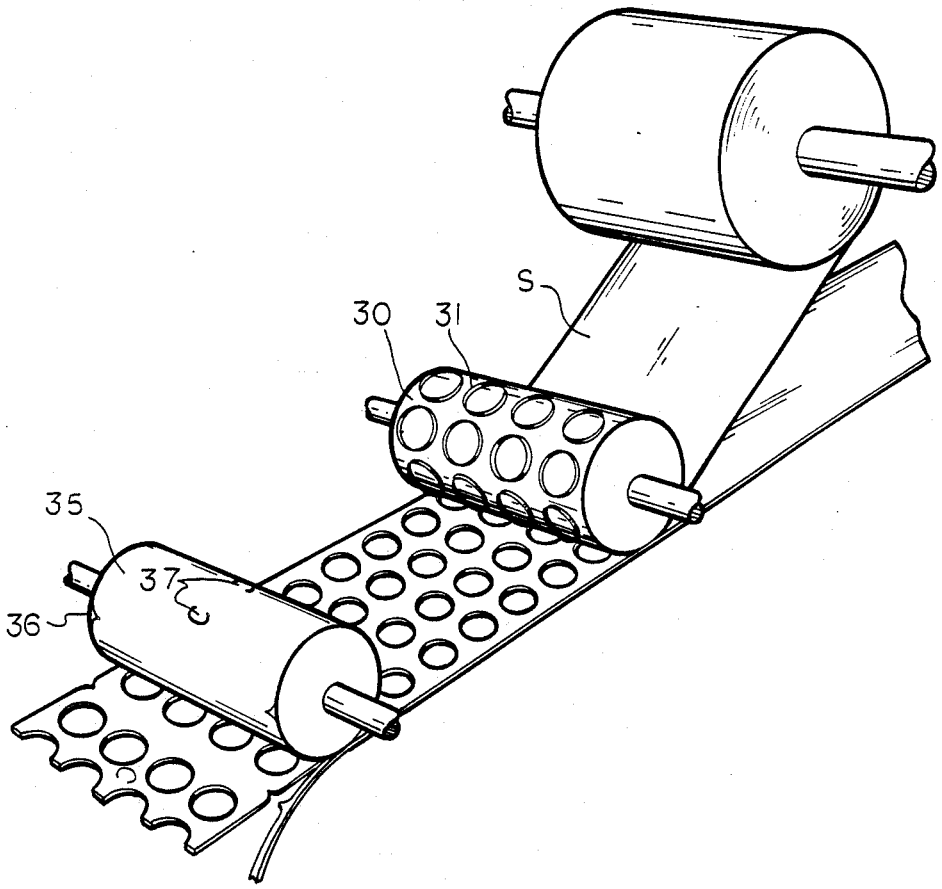
FIG. 7 is a schematic perspective view showing the making of the carrier.

The carriers are preferably formed by first forming a strip S with openings 22 by die cutting. As shown in FIG. 7, a first die cutting roll 30 has circular cutting edges 31 forming the openings. The web of carriers are then passed through a second die cutting roll 35 which includes cutting edges 36 that trim the side edges, cutting portions 37 that trim the corners, and cutting edges 37 that simultaneously form the finger tabs 24.

Figure 8:
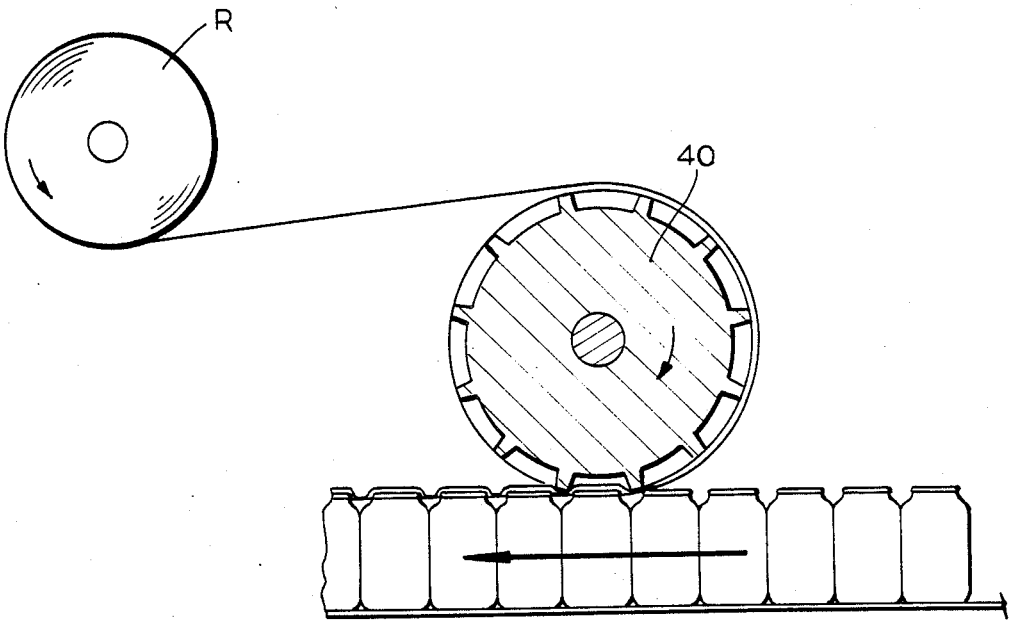
FIG. 8 is a schematic view showing the method of application of the carrier.

By this method a roll R of carriers is provided that can then be applied to successive arrays of cans as shown in FIG. 8. A strip of carriers may be severed for application to arrays of cans or delivered from a roll R to a wheel 40 that has arrays of circular openings. The periphery of roll R progressively applies the carriers to the cans, after which the carriers with cans thereon are severed from one another.

It has been found that the sheet 21 (FIGS. 4–6) of the carrier should preferably be made of a plastic material that is flexible but stiff and yet has sufficiently high modulus of elasticity as to tend to retain the cans in the original plane. Such stiffness is obtained by utilizing a high modulus material and having sufficient thickness in the sheet to provide the desired attribute of retaining the cans and holding the cans in an array such that the upper ends of the cans are maintained in substantially the same plane when the package is lifted utilizing the finger openings. This permits the package to be carried more readily especially where the package comprises 12 cans.

The plastic material is preferably made of material that incorporates components so that the carrier is degradable. The material may comprise, for example, plastic material described in U.S. Pat. No. 4,709,808.

It has been found that a satisfactory package may be made of material such as a polyolefin. Other plastic materials may be polyesters and nylons, coextruded plastics. The plastic material may include additives such as lubricants to facilitate application.

Preferably, the sheet comprises high density polyethylene. Satisfactory results have been achieved where the high density polyethylene sheet 21 has a thickness of 14 mils. Satisfactory results for retaining 12 ounce cans having a filled weight of 0.85 pounds per can are achieved where the sheet 21 has a thickness of 14 mils±1.

An example of a package comprises a sheet 21 of high density polyethylene having a melt index of 0.25, a density of 0.960 gm/cc and a thickness of 14 mils made by Allied Chemical Company and sold under the designation AA 60003. In the example of such a carrier for twelve cans, the overall dimension is 10.75 inches by 16.00 inches. The diameter of the openings was 2.125 inches and the distance between the openings was 2.6 inches. The cans were of conventional construction for beverages, made of aluminum or steel, and had normal dimensions as follows: Diameter of the body 2.6 inches; diameter of the bead 2.46 inches; height 4.8 inches; and inner diameter of the neck 2.26 inches. In one example, the modulus of elasticity of the sheet was 128,000 $lbs/in^2$ in the machine direction and 152,000 $lbs/in^2$ in the transverse direction. It has been found that such a package of twelve cans will withstand a shake test of repeated movement of at least 300 cycles with an amplitude of 1½ inches at a frequency of 73 cycles per minute without loss of engagement of any cans.

It has been found that a package made in accordance with the invention will withstand normal handling, storage, shipment and stacking without adversely affecting either the effectiveness of the package, the appearance or the ability to stack one package on another. Furthermore, the cans can be readily reinserted in the sheet after use thereby facilitating return of the cans for salvage and recycling.

Figure 9:
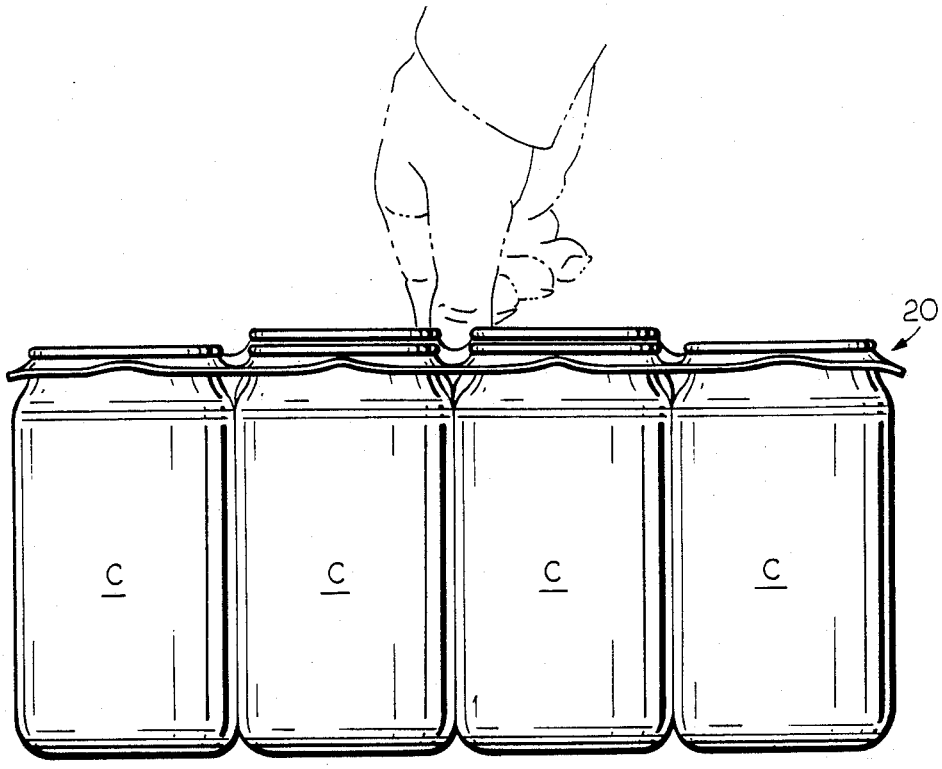
FIGS. 9 and 10 are side and end views, respectively, showing the can package when it is lifted.
Figure 10:
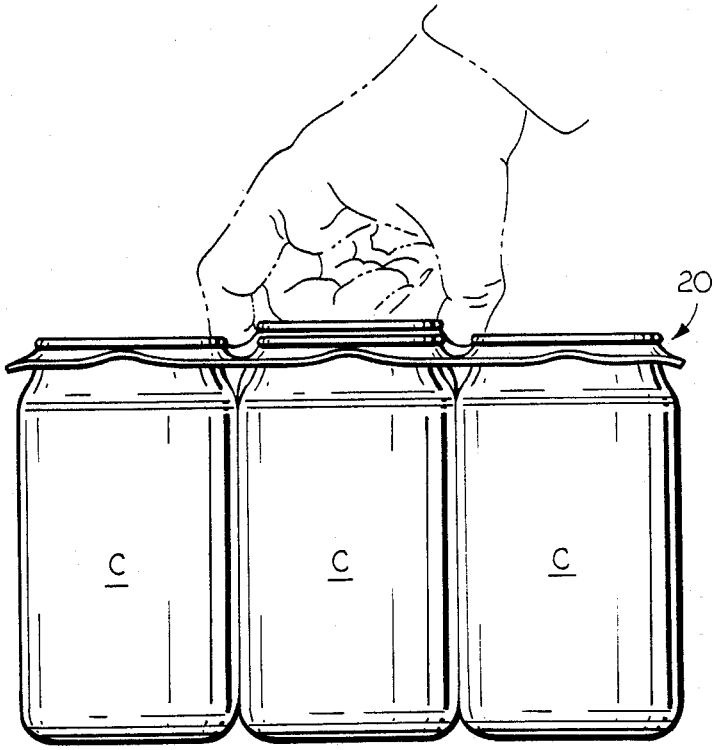

Referring to FIGS. 9 and 10 which show a can package of 12 cans being lifted, it can be seen that the can package holds the cans in substantially the same upper plane when it is grasped through the lifting openings. Only the cans in the middle of the package adjacent the finger openings are lifted slightly above the plane of the remaining cans. For example, in a package of 12 cans, it has been found that such movement is about ⅜ of an inch.

The carrier made in accordance with the invention may be contrasted to conventional ring type carriers presently used for holding cans in that the presently used carriers such as shown in the aforementioned U.S. Pat. Nos. 3,137,109 and 3,200,944 rely on predominately tensile forces to engage the neck of the cans below the beads along a cylindrical portion of the neck. In the carrier of the present invention, the relatively stiff sheet of the carrier engages under the beads of the cans and does not rely on engagement with a large surface of the neck of the can for holding the cans in position. The carrier also holds the cans in abutting relation to one another. Upon lifting of the package to carry it utilizing the finger openings, the upper ends of the cans remain in the same plane and the lower ends of the cans remain in contact and do not flair outwardly relative to one another even when the package is tilted from the horizontal. Although the peripheral cans tend to move slightly relative to the cans adjacent the center of the package, the upper ends of the cans lie substantially in the same plane and the package can be readily handled without the need for a band.

It can thus be seen that there has been provided a container package which utilizes a carrier which will effectively maintain the upper ends of the cans in a single plane when the package is lifted, even when a larger number of cans are lifted such as twelve cans; which will withstand the conditions of handling, storage, shipping and stacking; which will be aesthetically pleasing; wherein the carrier can be used for returning the containers for salvage or recycling; and which can be applied to the cans at commercially acceptable speeds.

It can further be seen that there has been provided a container package which holds the cans in tight side-by-side relationship wherein the package is lifted so that it is readily handled and transported; wherein each container can be readily released by a downward movement relative to the carrier; wherein each container can be readily reinserted; wherein no additional band is required about the cans; and which is cost effective.

Although the invention has been described in connection with cans, it is also applicable to other containers having a body portion, a peripheral bead or shoulder at the upper end thereof, and an inclined portion extending upwardly and inwardly from the body portion toward the bead.

We claim:

1. A container package for cans having a body portion, a peripheral bead at the upper end thereof, and an inclined portion extending upwardly and inwardly from the body portion toward the bead comprising an array of cans, a sheet of flexible plastic material having a plurality of openings for receiving the upper ends of the cans, said cans extending upwardly through the openings in the sheet with the periphery of the openings flexing upwardly and inwardly beneath the bead, the modulus of elasticity of said sheet, the thickness of said sheet, and the spacing and size of said openings being such that the cans are maintained in abutting relationship of the bodies thereof, the plane of the sheet remains substantially undisturbed, and the upper ends of the cans are maintained in substantially the same plane when the package is lifted by engaging the carrier,

2. The container package set forth in claim 1 including finger receiving tabs partially cut from the carrier sheet.

3. The container package set forth in claim 2 wherein said tabs are substantially oval.

4. The container package set forth in claim 3 wherein each said tab is hinged to the sheet along a line extending parallel to a row of openings.

5. The container package set forth in any of claims 1–4 including twelve cans, said sheet having twelve openings therein, said cans extending into said openings.

6. The container package set forth in any of claims 1–4 wherein the sheet is made of a polyolefin.

7. The container package set forth in any of claims 1–4 wherein said sheet is made of a high density polyethylene material.

8. The container package set forth in any of claims 1–4 wherein said sheet is made of high density polyethylene sheet and the thickness ranges between about 14 mils±1.

9. The container package set forth in any of claims 1–4 wherein said sheet is substantially rectangular having a straight side edge and a straight end edge, and said openings are provided in rows parallel to the side edge and end edge.

10. The container package set forth in claim 9 wherein said carrier when applied to the array of cans has the portions thereof between said carriers formed into V-shaped beams between the cans longitudinally and transversely of the cans.

11. The container package set forth in any of claims 1–4 wherein said plastic material is degradable.

12. A carrier for a container package for cans having a body portion, a peripheral bead at the upper end thereof, and an inclined portion extending upwardly from the body portion and inwardly toward the bead, said carrier comprising a sheet of flexible plastic material having a plurality of openings for receiving the upper ends of the cans, the modulus of elasticity of said sheet, the thickness of said sheet, and the spacing and size of said openings being such that when the carrier is applied to an array of cans, the cans are maintained in abutting relationship of the bodies thereof, the plate of the sheet remains substantially undisturbed, and the upper ends of the cans are maintained in substantially the same plane when the package is lifted by engaging the carrier.

13. The carrier set forth in claim 12 including finger receiving tabs partially cut from the carrier sheet.

14. The carrier set forth in claim 13 wherein said openings are substantially oval.

15. The carrier set forth in claim 14 wherein each said tab is hinged to the sheet along a line extending parallel to a row of openings.

16. The carrier set forth in any of claims 12–15 wherein said sheet has twelve openings therein.

17. The carrier set forth in any of claims 12–15 wherein the sheet is made of polyolefin.

18. The carrier set forth in any of claims 12–15 wherein said sheet is made of a high density polyethylene material.

19. The carrier set forth in any of claims 12–15 wherein said sheet is made of high density polyethylene sheet and the thickness ranges between about 14 mils$\pm$1.

20. The carrier set forth in any of claims 12–15 wherein said sheet is substantially rectangular having a straight side edge and a straight end edge, and said openings are provided in rows parallel to the side edge and end edge.

21. The carrier set forth in claim 20 wherein said carrier when applied to the array of cans has the portions thereof between said carriers formed into V-shaped beams between the cans longitudinally and transversely of the cans.

22. The carrier set forth in any of claims 12–15 wherein said plastic material is degradable.

* * * * *